US005957062A

United States Patent [19]

Cox et al.

[11] Patent Number: 5,957,062

[45] Date of Patent: Sep. 28, 1999

[54] FOLDING TABLE

[75] Inventors: Lewis D. Cox; Steven J. Hill, both of Knoxville, Tenn.

[73] Assignee: Falcon Products, Inc., Newport, Tenn.

[21] Appl. No.: 09/138,180

[22] Filed: Aug. 21, 1998

Related U.S. Application Data

[63] Continuation of application No. 08/618,466, Mar. 15, 1996, abandoned.

[51] Int. Cl.[6] ..... A47B 3/00

[52] U.S. Cl. ..... 108/133; 248/188.6

[58] Field of Search ..... 108/131, 132, 108/115, 127, 129, 133; 248/188.6

[56] References Cited

U.S. PATENT DOCUMENTS

| | | |
|---|---|---|
| Re. 30,020 | 6/1979 | Spencer et al. . |
| 155,999 | 10/1874 | Valley . |
| D. 314,299 | 2/1991 | Diffrient . |
| D. 324,615 | 3/1992 | Diffrient . |
| D. 336,394 | 6/1993 | Ball . |
| 489,369 | 1/1893 | Case . |
| 628,712 | 7/1899 | Hoshour . |
| 1,044,879 | 11/1912 | Fye . |
| 1,571,807 | 2/1926 | Schmitt . |
| 1,585,598 | 5/1926 | Miner . |
| 1,593,975 | 7/1926 | Karstens . |
| 1,842,954 | 1/1932 | Anderson . |
| 1,939,459 | 12/1933 | Murray . |
| 1,939,904 | 12/1933 | Koopman . |
| 1,956,946 | 5/1934 | Duffy . |
| 1,959,725 | 5/1934 | Lindsay . |
| 2,294,575 | 9/1942 | Schneider . |
| 2,695,827 | 11/1954 | De Saussure, Jr. . |
| 2,836,475 | 5/1958 | Sapp . |
| 3,034,153 | 5/1962 | Sargent . |
| 3,117,535 | 1/1964 | Hendrickson . |
| 3,124,085 | 3/1964 | Sanchez . |
| 3,349,728 | 10/1967 | Barecki et al. . |
| 3,628,471 | 12/1971 | Burr . |
| 3,805,710 | 4/1974 | Leshem . |
| 3,818,844 | 6/1974 | Burr . |
| 4,064,815 | 12/1977 | Baum . |
| 4,099,469 | 7/1978 | Sahli . |
| 4,163,592 | 8/1979 | Nelson . |
| 4,168,870 | 9/1979 | Hill . |

(List continued on next page.)

FOREIGN PATENT DOCUMENTS

| | | |
|---|---|---|
| 38259 | 3/1909 | Austria . |
| 2561725 | 3/1984 | France . |
| 2618652 | 7/1987 | France . |
| 2624176 | 12/1987 | France . |
| 2630312 | 4/1988 | France . |
| 2639408 | 11/1988 | France . |
| 1076920 | 4/1953 | Germany . |
| 2049025 | 12/1990 | United Kingdom . |

*Primary Examiner*—Peter M. Cuomo
*Assistant Examiner*—Gerald A. Anderson
*Attorney, Agent, or Firm*—Polster, Lieder, Woodruff & Lucchesi, L.C.

[57] ABSTRACT

A folding table (1) with a table top (5) and a pair of breakaway legs (15) supporting the top. A brace member (47) at each end of the table has a leg assembly (7,9) attached thereto. A top supporting beam (11) extends along the table top between the brace members. The support beam is pivotally mounted to the table top. Each leg assembly has a hinge structure (35) near its top end and a foot structure (24) at its bottom end. The hinge (35) allows the leg (15) to break down and fold inwardly against the table top. A pair of leg braces (81,83) are attached to the support beam and are moveable with the beam. Each leg brace is removably attached to a corresponding leg by a locking assembly (87). When the leg braces (81,83) are attached to the leg, they transfer downward force from the table top to the legs at a point below the hinges (35) to keep the legs in the unfolded position. The locking assembly (87) can be disengaged and the leg braces pivoted out of the way to allow the legs to be folded. A wire gallery (13) is removably attached to the leg braces (81,83) below the table top.

7 Claims, 14 Drawing Sheets

U.S. PATENT DOCUMENTS 4,444,124 4/1984 Burr .
4,550,666 11/1985 Svoboda .
4,561,622 12/1985 Heinzel .
4,646,654 3/1987 Sullivan .
4,653,804 3/1987 Yoo et al. .
4,662,286 5/1987 Barabas et al. .
4,690,468 9/1987 Lau .
4,734,826 3/1988 Wilson et al. .
4,748,913 6/1988 Favaretto et al. .
4,750,432 6/1988 McNamara et al. .
4,827,850 5/1989 Diffrient .
4,827,851 5/1989 Diffrient .
4,838,181 6/1989 Luyk .
4,879,955 11/1989 Moll et al. .
4,884,513 12/1989 Newhouse et al. .
5,094,174 3/1992 Grund et al. .
5,109,778 5/1992 Berkowitz et al. .
5,144,888 9/1992 Heine et al. .
5,205,223 4/1993 Ball et al. .
5,279,233 1/1994 Cox .
5,337,657 8/1994 Diffrient .

FOLDING TABLE

This application is a continuation of application Application Ser. No. 08/618,466 filed on Mar. 15, 1996 now abandon.

BACKGROUND OF THE INVENTION

This invention relates to folding tables, and in particular, to a folding table having articulated legs to allow folding and unfolding of the legs. While the invention is described with particular reference to computer and/or conference tables, those skilled in the art will recognize the wider applicability of the inventive principles disclosed hereinafter.

Folding tables are well known to the art. They commonly are used in homes, offices, training rooms, cafeterias and so forth when extra table space is needed. When not in use, the tables are folded up and store in some unobtrusive manner. However, the folding and locking mechanisms of prior art folding tables tend to be complex, having a multitude of moving parts, and generally are incorporated at the juncture of the leg and the table top, making the folding mechanism and the leg an inseparable. This reduces the flexibility of the designs.

Recently, folding tables more commonly are used to support electronic devices, particularly personal computers and the like. Personal computers, along with other paraphernalia, such as a printer, telephone and personal work items represent a considerable amount of weight to be supported by the table. Prior art folding tables, particularly those with a long spans and conventional folding and locking mechanisms, tend to bow under the weight. Moreover, the additional weight can cause the legs to splay. On the other hand, the added weight may cause the folding mechanism of some prior art tables to fail and fold up under the weight of the load as indicated above A number of table designs having folding legs or mechanisms are well known in the art. For example, U.S. Pat. 5,337,657('657), issued Aug. 16, 1994, illustrates one form of such table. While the '657 patent, for example, speaks of a "beam" extending lengthwise of the table, the beam is thin corrugated sheet steel form plate which is not intended to function and which does not function in the manner of the support beam structure of the present invention.

Further, these electronic devices such as computers, monitors, printers and telephones have power supply or connection cords or wires that generally dangle from the rear edge of the table. The loose wires are unsightly and present a safety hazard if the user becomes entangled in the exposed wires. Our invention provides a wire gallery structure adaptable to a number of table constructions. This adaptability is accomplished through the use of self contained wire manager units which can be attached to any of a variety of table constructions without interfering with other table functions.

SUMMARY OF THE INVENTION

It is among the principal objects of the present invention to provide a folding table having a leg assembly which allows the legs of the table to be folded up for storage or stacking.

Another object of the present invention is to provide a folding table wherein the folding mechanisms are located along the legs and not the associated table top.

Another object of the invention is to provide a folding table wherein the folding legs easily can be lengthened or shortened without requiring modification of the folding mechanism.

Still another object of the invention is to provide a folding table wherein a support beam extending the length of the table functions as a weight bearing member and not as a component of the leg folding mechanism.

Another object of the invention is to provide a folding table wherein the load exerted on the table top functions to maintain the legs in an unfolded position and resist folding mechanism failure under a load.

Yet another object of the invention is to provide a folding table wherein the braces extending from the table top to the foldable legs are designed exert a positive pressure on the legs, when the legs are in their unfolded position, so that the weight on the table functions to keep the legs in their unfolded, supportive position under the table top.

Another object of the invention is to provide a removable wire guide under the table top to house electrical cords or wires extending from electronic devices resting on the table top.

Another object of the invention is to provide such a removable wire guide that can be stored separately from the table when the foldable legs are moved from an unfolded to a folded position.

Another object of this invention is to provide an easy to operate and simply constructed plunger assembly for use with a folding table. These and other objects of the folding table of the present invention will be apparent from the accompanying specification and drawings.

In accordance with the invention, briefly stated, a folding table is provided in one illustrative preferred form, with a top and a pair of breakaway legs supporting the top. A brace member at each end of the table has a leg assembly attached to each brace member. A top supporting beam extends along the table top in the area between the brace members. The support beam is pivotally mounted to the table top. Each leg assembly has a hinge structure near its top end and a foot structure at its bottom end. The hinge is designed to allow the leg to break down and fold inwardly against the table top. A pair of leg braces are attached to the support beam and are moveable with the beam. Each leg brace also is removably attached to a corresponding leg by a simplified spring-biased plunger assembly. When the braces are attached to the leg, they transfer downward force from the table top to the legs at a point below the hinges to keep the legs in the unfolded position. The plungers can be removed from their interlock position with the legs, enabling the braces to be pivoted out of the way and allowing the legs to be broken down or folded. The braces have a triangular form in the preferred embodiment.

A wire gallery assembly is removably attached to the braces below the table top. The wire gallery has a wire tray to accommodate loose wire and any associated wiring harness. The wire tray has a hinged cover that can be opened to expose the wiring or closed to cover the wiring. The cover also functions as a modesty panel.

BRIEF DESCRIPTION OF THE DRAWINGS

Corresponding reference figures indicated corresponding elements throughout the various drawings.

DESCRIPTION OF THE PREFERRED EMBODIMENT

Figure 1:
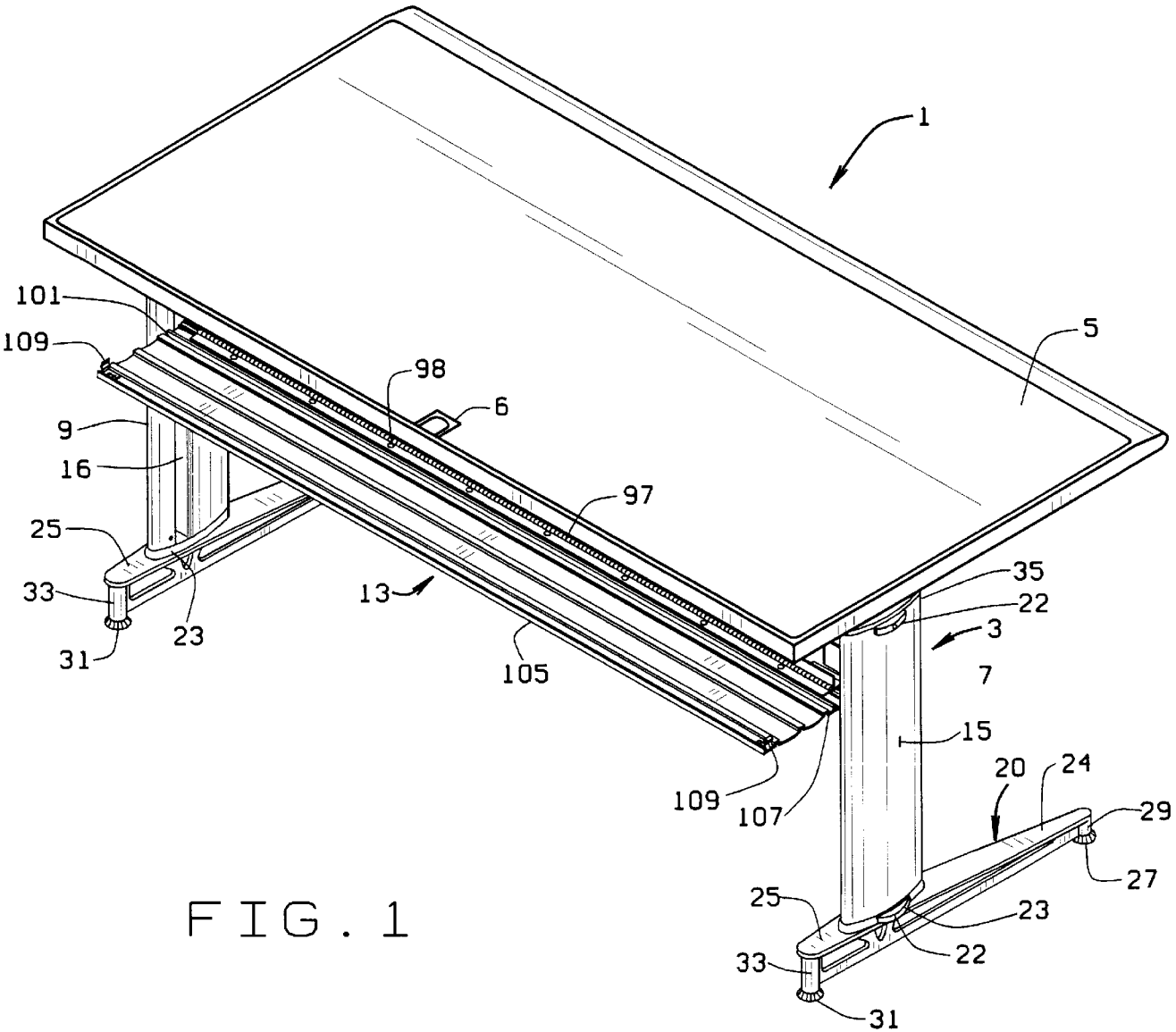
FIG. 1 is an isometric view of one illustrative embodiment of folding table of the present invention, one illustrative embodiment of the wire gallery being shown in an open position.
Figure 2:
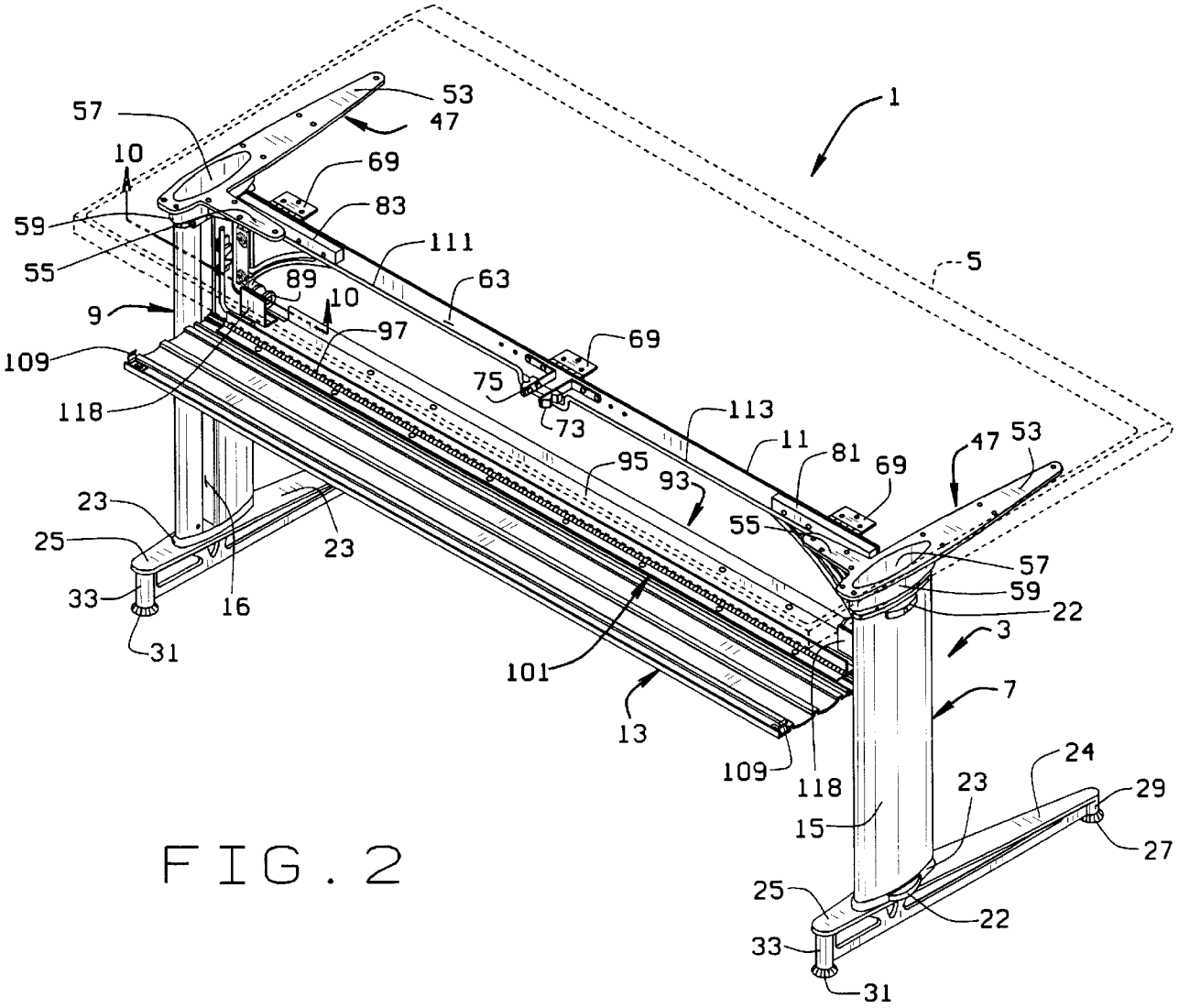
FIG. 2 is the isometric view of the folding table of FIG. 1, the table top being shown in phantom.

One illustrative embodiment of folding table of the present invention is indicated generally in the drawings by reference numeral 1. As best seen in FIGS. 1 and 2, table 1 includes a support frame assembly, indicated generally by reference numeral 3, supporting a substantially flat, rectangular table top 5. It will be appreciated that table top 5 can be of any conventional configuration and can have one or more openings, such as an opening 6, formed in it to allow the introduction of wires. It also will be appreciated by those skilled in the art that the frame assembly 3 can be used to support a table top of any length and can be conveniently modified to elevate table top 5 any desired distance from the floor.

Frame assembly 3 includes two spaced apart folding leg assemblies 7 and 9, respectively. A support beam 11 extends between the respective leg assemblies to provide substantial support to the table top and prevent the table top from bowing under weight of objects placed upon the table top, regardless of the span of the tabletop. A wire gallery assembly 13 is suspended below the beam and serves to conveniently house electrical wires or the like which extend down from objects resting on table top 5. The foregoing major components of folding table 1 now will be described in greater detail, with reference primarily being made to FIG. 3.

Figure 10:
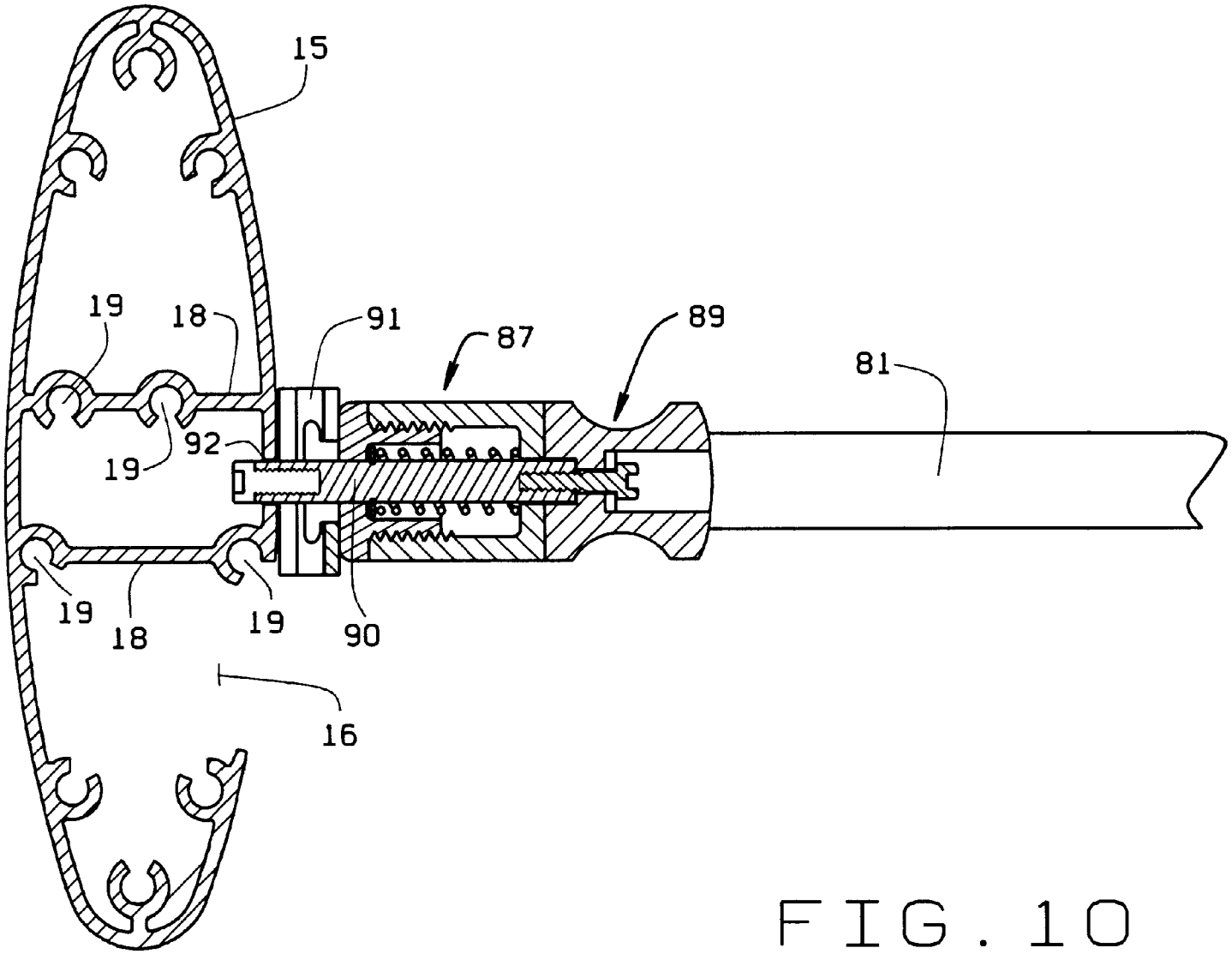
FIG. 10 is an enlarged cross-sectional view of a leg and plunger taken along line 10—10 of FIG. 2

Leg assembly 7, with leg assembly 9 being nearly identical thereto, has an elongated, substantially hollow body section 15. Leg assembly 9 differs from leg assembly 7 only in specific details described below, and except for such details, is not described in detail. Body section 15, in the embodiment illustrated, has a generally oval cross-section, although other configurations are compatible with the broader aspects of our invention. Each body section 15 has an opening 16 along the length thereof that allows access into the body for the concealment of wires or cords or the like Opening 16 can have an optional cover 17 (FIG. 14) to better conceal the wires and the opening. Interior support struts 18 (FIG. 10) with threaded holes 19 formed in the ends, extend the length of the interior cavity of the body to provide rigidity to the body and provide anchors for other components. A surface engaging foot 20 is attached to the bottom end of body 15 by a plurality of screws 21 or other appropriate attachment devices. The screws 21 engage threaded holes (not shown) in the bottom end of the support struts. The leg assembly 7 also has a plurality of resilient protective bumpers 22 associated with it. The bumpers 22 are used to protect the tables, during storage, for example. A decorative and protective band 23 is placed between the bottom end of the body 15 and closes the juncture between the body and the foot 19. Foot 20 has a substantially elongated toe section 24 and a somewhat shorter heel section 25. Foot 20 is of an appropriate overall length so as to provide stability and prevent tipping of the table. There is a first adjustable glide 27 threadedly attached to an internally threaded boss 29 on the end of the toe section 24 and a similar adjustable glide 31 threadedly attached to an internally threaded boss 33 on the end of the heel section 25. The respective glides can be rotated to level the foot on its supporting surface. As appreciated by those skilled in the art, a symmetrical foot may be employed, if desired.

Figure 11B:
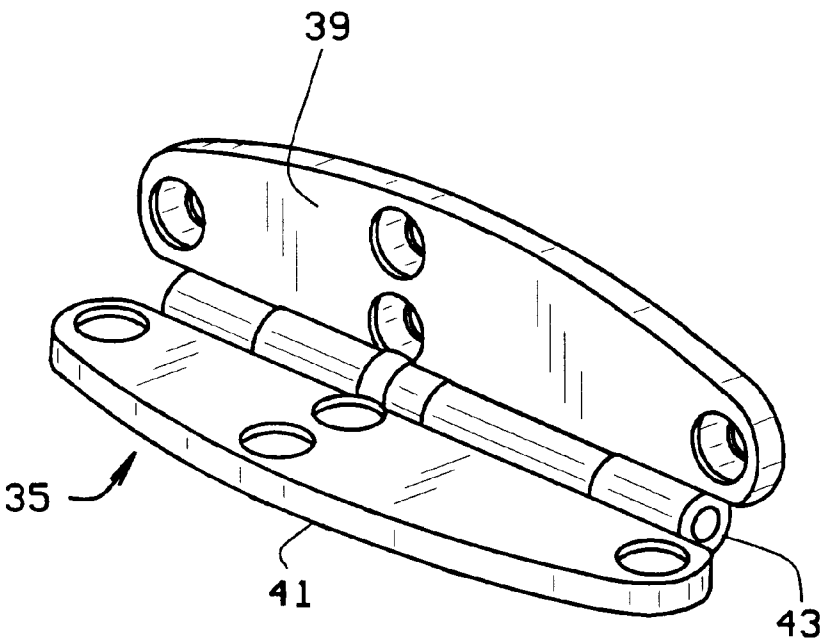
FIG. 11B is a perspective view of another embodiment of a leg hinge of the present invention.
Figure 11A:
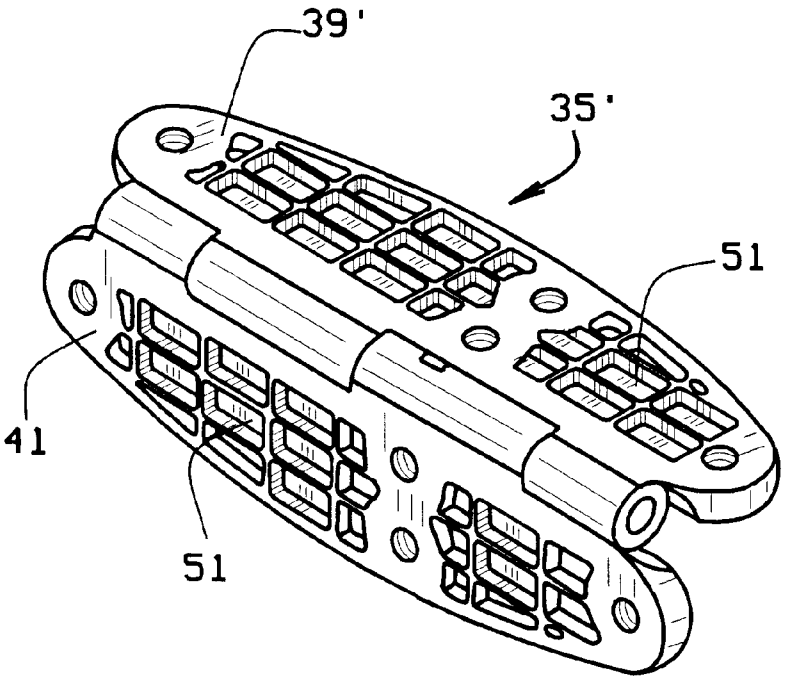
FIG. 11A is a perspective view of one embodiment of a leg hinge of the present invention.

A hinge 35 is attached to the upper end of body 15 with screws 37, or by other appropriate devices, which engage threaded holes 19. The hinge 35, shown in greater detail in FIG. 11B, has a general clam-shell configuration with a top half 39 attached to a bottom half 41 along a hinge pin 43. FIG. 11A illustrates a second embodiment of the hinge. In FIG. 11A, it should be noted that the top half 39' and bottom half 41' of the hinge 35' employed with leg assembly 9, for example, has a plurality of openings 51 formed therein. Openings 51 allow the introduction of cords or electric wires into body 15 of leg assembly 9 as will be explained in greater detail below.

The bottom half 41 of each hinge is attached to the upper end of body 15, as stated above, and the upper half 39 is attached to a table top mounting brace 47 with a plurality of screws 49 or other appropriate attachment devices. Each brace 47 has a substantially flat, elongated first brace member 53 and an integral but short second brace member 55 at a right angle to the first brace member in the embodiment illustrated. The respective base members are secured to the bottom surface of the table top 5 with screws 56 or other appropriate attachment means. At the juncture of the respective brace members is a generally ovoid opening 57 formed a first end of the brace member 53, which is defined on the bottom side (referenced to FIG. 3), by a circumferential depending skirt 59. It will be appreciated that skirt 59 in the assembled arrangement of parts, will appear as a part of the upper end of body 15.

As mentioned above, there is an elongated beam 11 running along the bottom side of the table top 5, between the two brace members 53. As shown, beam 11 generally is L-shaped, having a generally vertically disposed wall 63 and a short, perpendicular lip 65 extending outwardly from the wall 63 along a bottom edge thereof. Beam 11 has a plurality of hinges 69 attached to the wall 63. In the embodiment shown, three hinges 69 are spaced equal distances along the length of the beam. The top half of each hinge is attached to the underside of the table top with screws 71 or other appropriate attachment means. A pair of latches 73 and 75 are attached to the wall 63 with screws 77 or the like. Latches 73 function to hold the legs in a folded position as will be further explained below.

Figure 3:
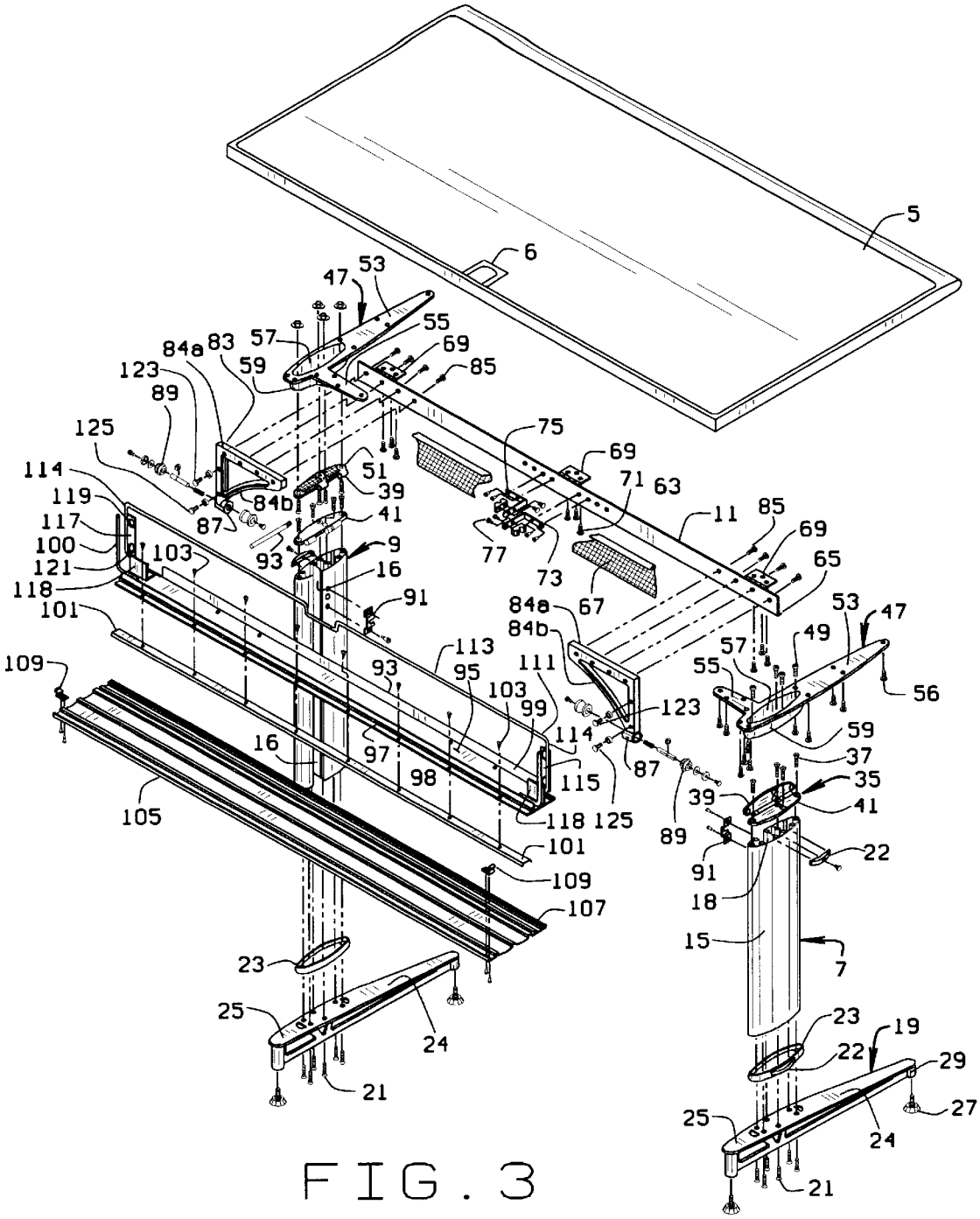
FIG. 3 an exploded view of the folding table shown in FIG. 1.

A first brace 81 is mounted between beam 11 and leg assembly 7 and a second brace 83 is mounted between beam 11 and leg assembly 9. The braces 81 and 83 are identical to one another in the embodiment illustrated, and preferably are triangular in silhouette. As illustrated, each brace 81, 83 is attached to beam 11 by a plurality of screws 85 or other appropriate attaching device. Each brace 81, 83 has an upper end 84A and a lower end 84B. The lower end 84B has a plunger boss 87 formed in it. A spring biased plunger 89 having a plunger pin 90 is mounted in each boss 81, as shown in greater detail in FIG. 10. There is a complementary keeper bracket 91 attached to the inside face of each leg assembly, just below the hinges 35 which accepts and aligns pin 90 with an opening 92 formed in the respective legs. When table 1 is fully assembled with the legs unfolded, as shown in FIGS. 2 and 3, the respective pins 91 are biased into the opening 92 to secure the bottom end 84B of the respective braces 81, 83 to the leg assemblies. The structural arrangement described above satisfies several major objectives of the present invention. First, the beam 11 functions primarily as a load bearing support and does not constitute an element of the folding mechanism, as found with many prior art folding tables. Second, as downward pressure is place on beam 11 by a load place on the table top, the pressure is transferred to the inner surface of the legs via the braces 81, 83 to urge the legs outward against hinges 35, the force acting to hold the legs in their unfolded position. Therefore, rather than acting to cause the collapse of a folding table, the load on the folding table of the present invention acts to stabilize the entire structural combination in use.

Figure 9:
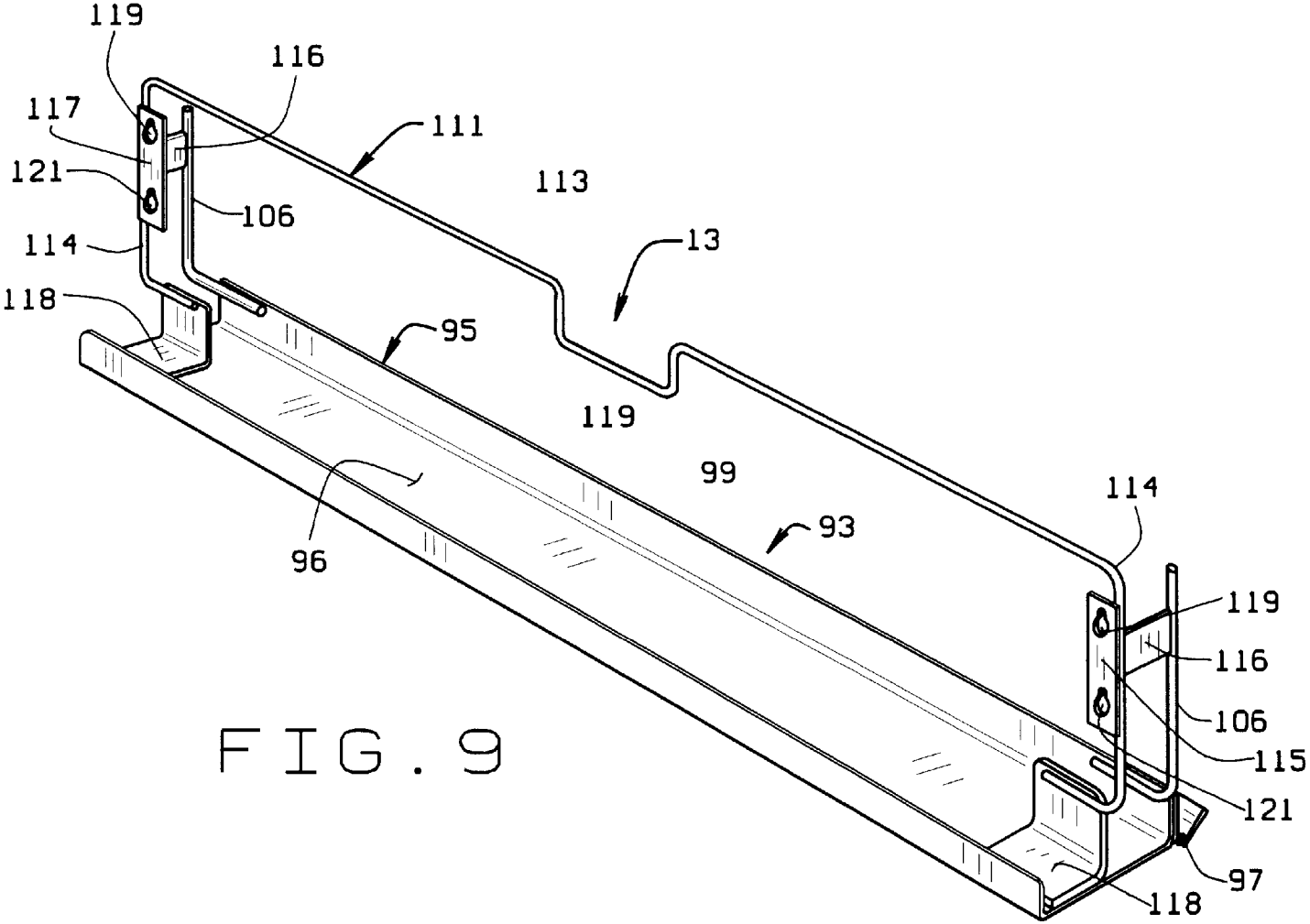
FIG. 9 is an enlarged perspective view of the wire gallery assembly, the cover and rear wall not shown for drawing simplicity.

The wire gallery assembly 13, shown in greater detail in FIGS. 3 and 9, includes a wire gallery 93. Wire gallery 93 includes a substantially flat tray section 95 ,shown in greater detail in FIG. 9, defined by a bottom wall 96. A hinge 97 extends along the front edge of tray section 95. A raised edge 99 extends along the rear edge of the tray section 95. Raised edge 99 is designed to permit attachment of the previously mentioned screen 67. Screen 67 delineates a back wall of the wire gallery assembly 13.

One arm of hinge 97 has a plurality of holes 98 formed in it, for attaching a cover support 101 to the arm. Attachment is accomplished with rivets 103 or other appropriate fastener devices. Cover support 101 is a substantially resilient U-shaped member. A wire gallery cover 105 is attached to the wire gallery by inserting the cover support 101 into a channel 107 formed in the interior face of the cover 101. A pair of detents 109 are attached to each upper end corners of the cover 105.

The wire gallery employs two skeletal frames. There is first skeletal frame defined by an end part 106 at one end of the tray and a second end part 106 at the other end of the tray. The end parts 106 receive the detents 109 to hold the cover 101 in its closed position. As will be appreciated by those skilled in the art, detents 109 alternatively may be mounted in the end part 106 rather than the cover 109, if desired. Other similar arrangements are compatible with the broader aspects of our invention.

The second skeletal frame is a wire gallery mounting frame 111, which is adapted and arranged to permit the removal and attachment of the wire gallery assembly 13 to the braces 81 and 83. Mounting frame 111 is an elongated, C-shaped frame 113 having a horizontal rod member 113 and two vertical oppositely end opposed sections 114. End plates 115 and 117 are welded or otherwise attached to the inside of end sections 114. Wire frame 111 is attached to tray 96 by a pair of L shaped brackets 118 by welding or other appropriate means. It will be appreciated that the second skeletal frame is spaced apart from the first skeletal frame but connected at each end by braces 118 that extend between the end members 106 and the end sections 114 or mounting pieces 115 and 117. It should be noted that there is a central indention 119 in rod member 113 to accommodate the leg latches 73 and 75. Each plate 115 and 117 has a pair of vertically aligned, key-hole type openings 119 and 121 formed in it.

There are a pair of vertically aligned mounting pins 123 and 125 protruding from the brace 81, 83. The respective openings 119 and 121 are designed to engage the pins 123 and 125 to mount the wire gallery assembly removably to the brace members 81, 83. This novel construction allows the wire gallery assembly to be removed, if not needed, or used interchangeably with another table having similarly arranged mounting pins or screws.

Figure 5:
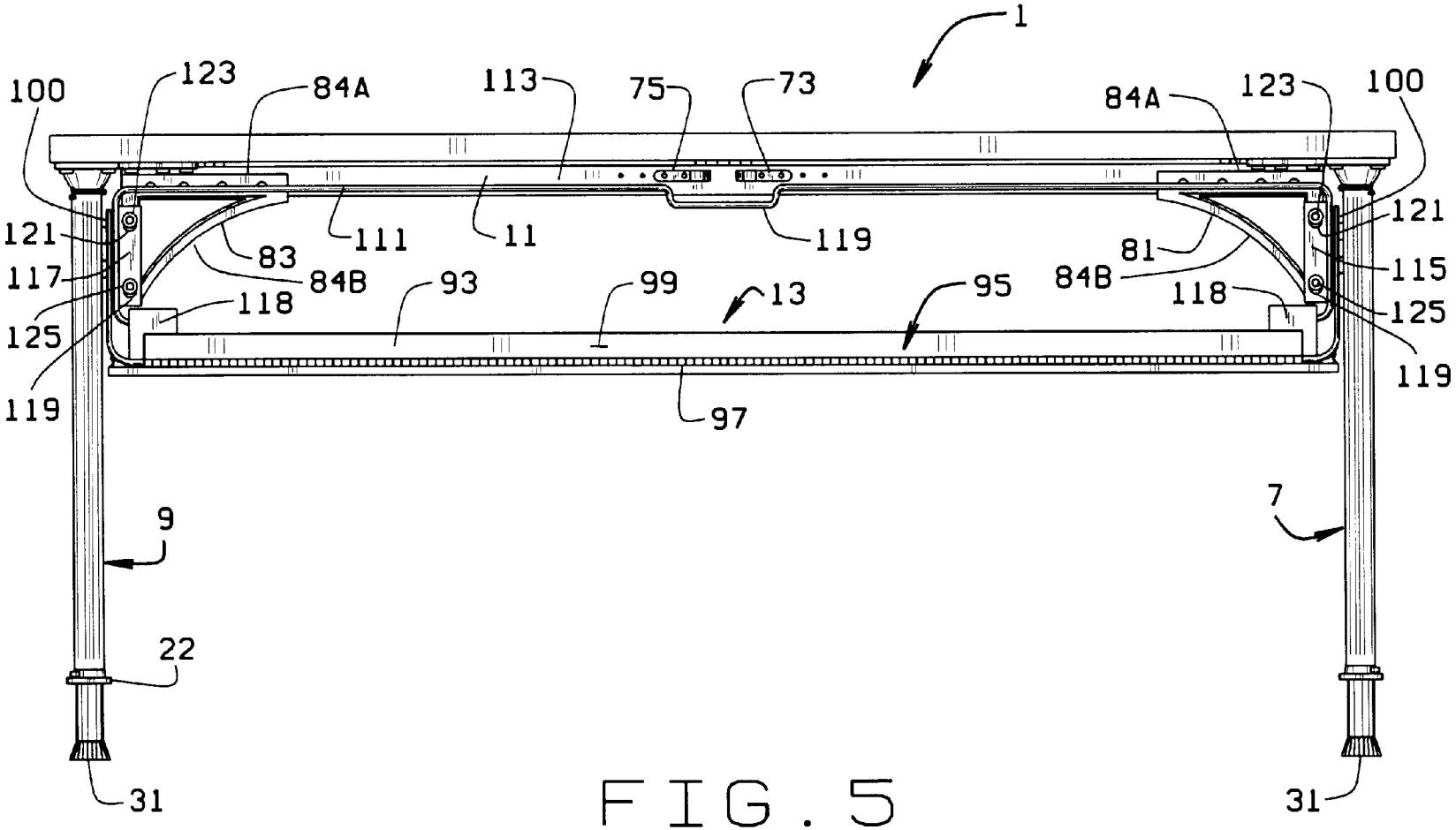
FIG. 5 is a front elevation of the folding table shown in FIG. 1, the wire gallery cover being in an open position, the rear net wall not shown for drawing simplicity.
Figure 6:
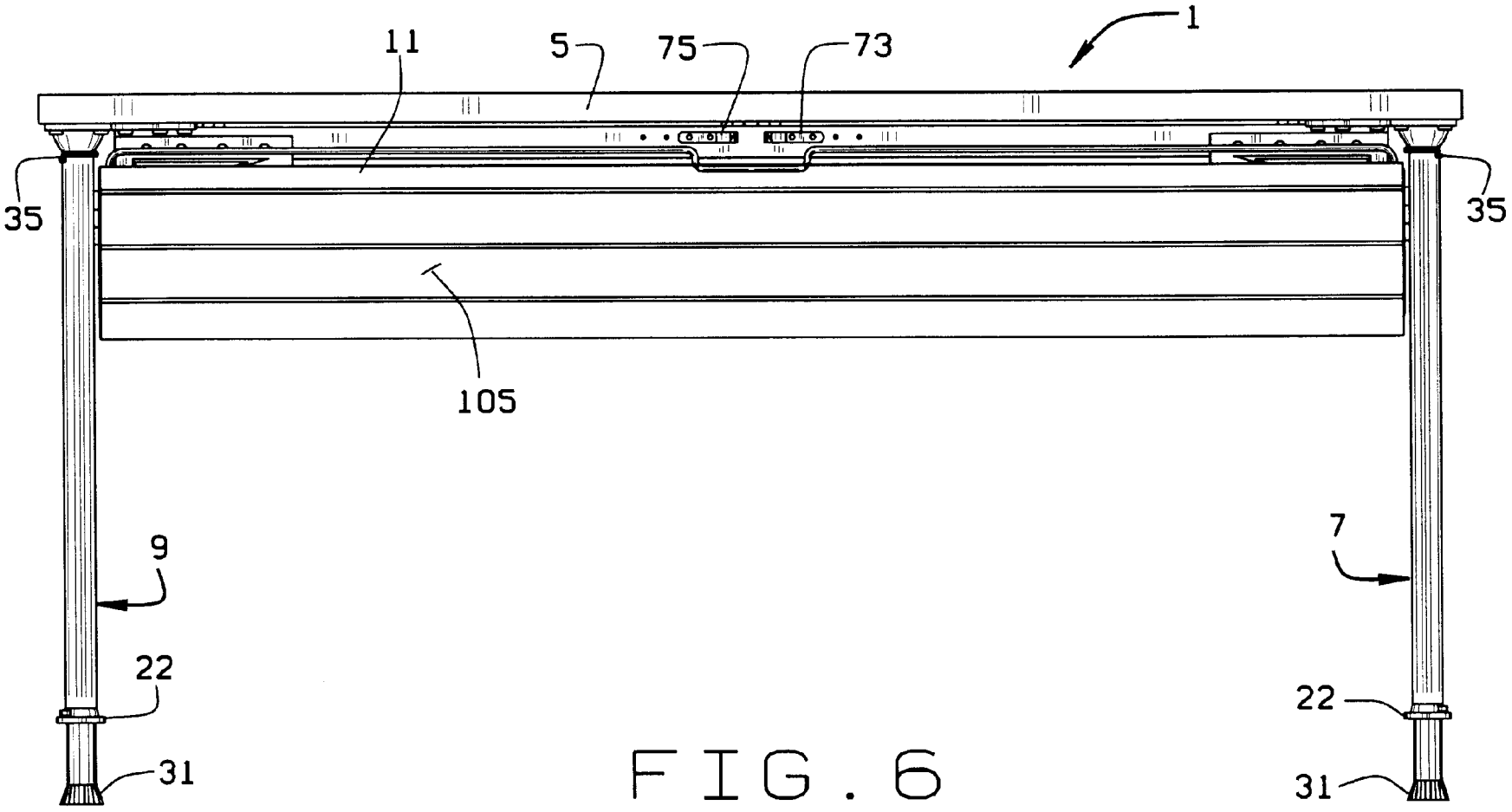
FIG. 6 is a front elevation of the folding table of the present invention, the wire gallery cover being in an closed position.

FIGS. 5–8 illustrate the foldable features of the folding table 1 of the present invention. First, FIG. 5 shows the table fully assembled with the wire gallery cover 105 opened. FIG. 6 shows table 1 fully assembled with the wire gallery cover 105 closed to give an aesthetically pleasing finished look to the table and to function as a modesty panel. To close cover 105, the cover is pivoted about hinge 97. Detents 109 engage the end parts 106 to secure the cover in place, to hide wire strung therein, and to serve as a modesty panel. Further, it will be appreciated that tray 95 is designed to hold a plurality of electrical cords or wires or the like extending from devices resting on the table top. Moreover, the wires can be concealed inside a leg assembly, for example leg assembly 9 by introducing the wires through openings 6 and 57, through the openings 51 in top hinge piece 39 and down through the channel 16 in body 15 and out of the bottom of channel 16 to a source of electrical energy, for example. On the other hand, the wires can drop down from the table adjacent leg assembly 9 and extend across the tray to leg assembly 7 or vice versa, depending upon the location of an electrical outlet, for example, as will be further described below.

Figure 7:
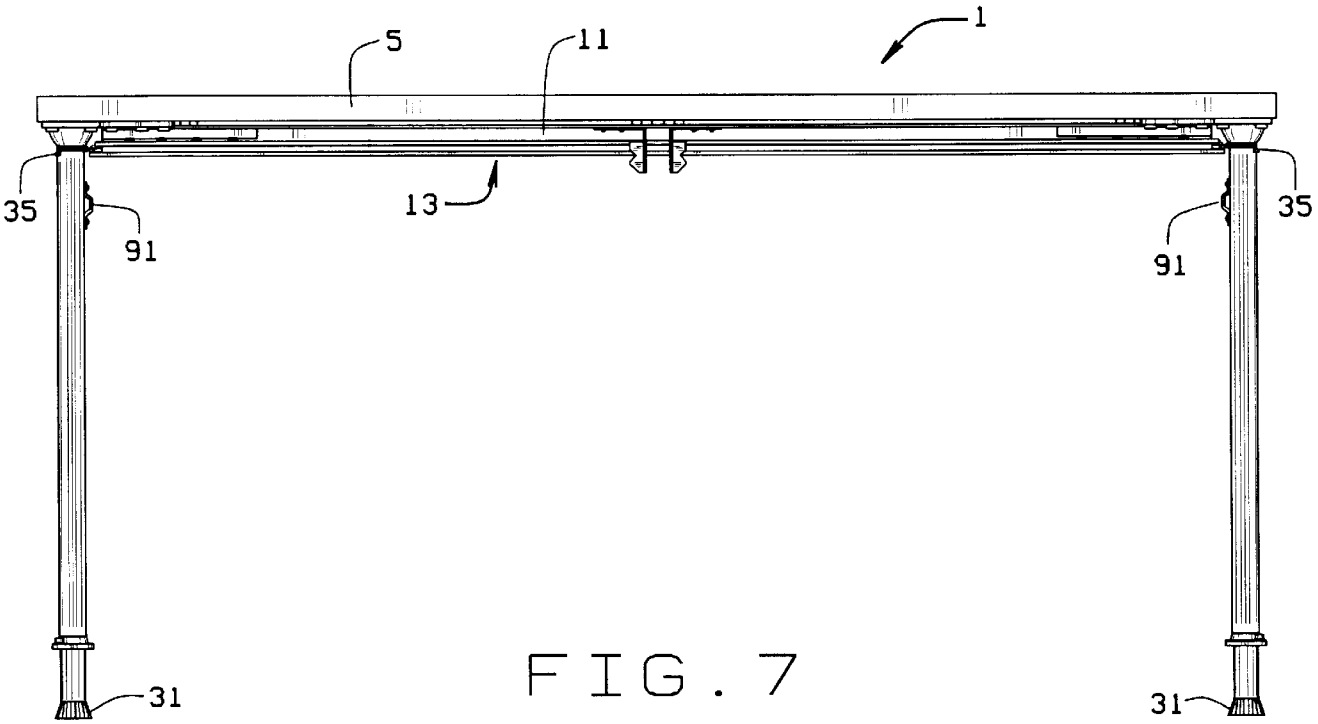
FIG. 7 is a front elevation of the folding table of the present invention, showing the leg braces in their stored position, the wire gallery being removed.
Figure 8:
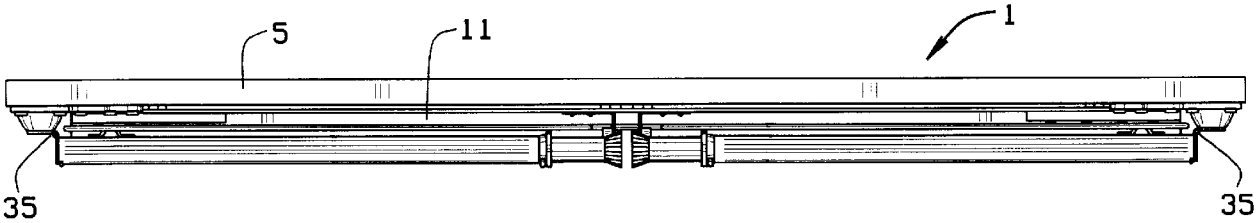
FIG. 8 is a front elevation of the folding table of the present invention, the foldable legs in a folded position.

The folding feature of table 1 is shown in FIGS. 7 and 8. First, the wire gallery 13 is removed from the mounting screws. The plungers 89 are with drawn from the holes 92 and keeper brackets 97. The support beam 11, bearing the freed triangular braces 81 and 83, is pivoted about the hinges 69 until the braces are flush to the bottom surface of the table top. The legs then break or are pivoted inward about hinges 35 until they are parallel to the table top, as shown in FIG. 8. The legs are secured in the folded position by snapping into latches 73 and 75.

Figure 4:
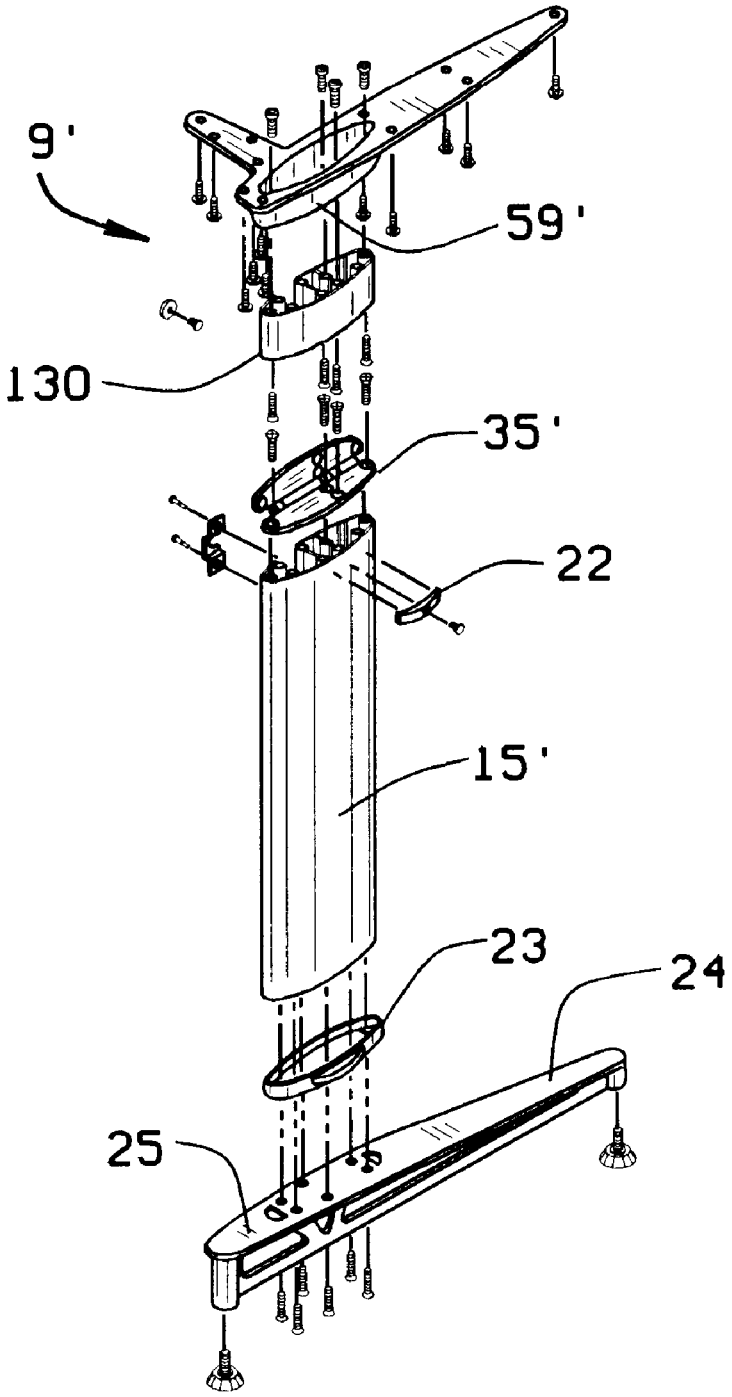
FIG. 4 is an exploded view of one foldable leg assembly of the folding table shown in FIG. 1.
Figure 12:
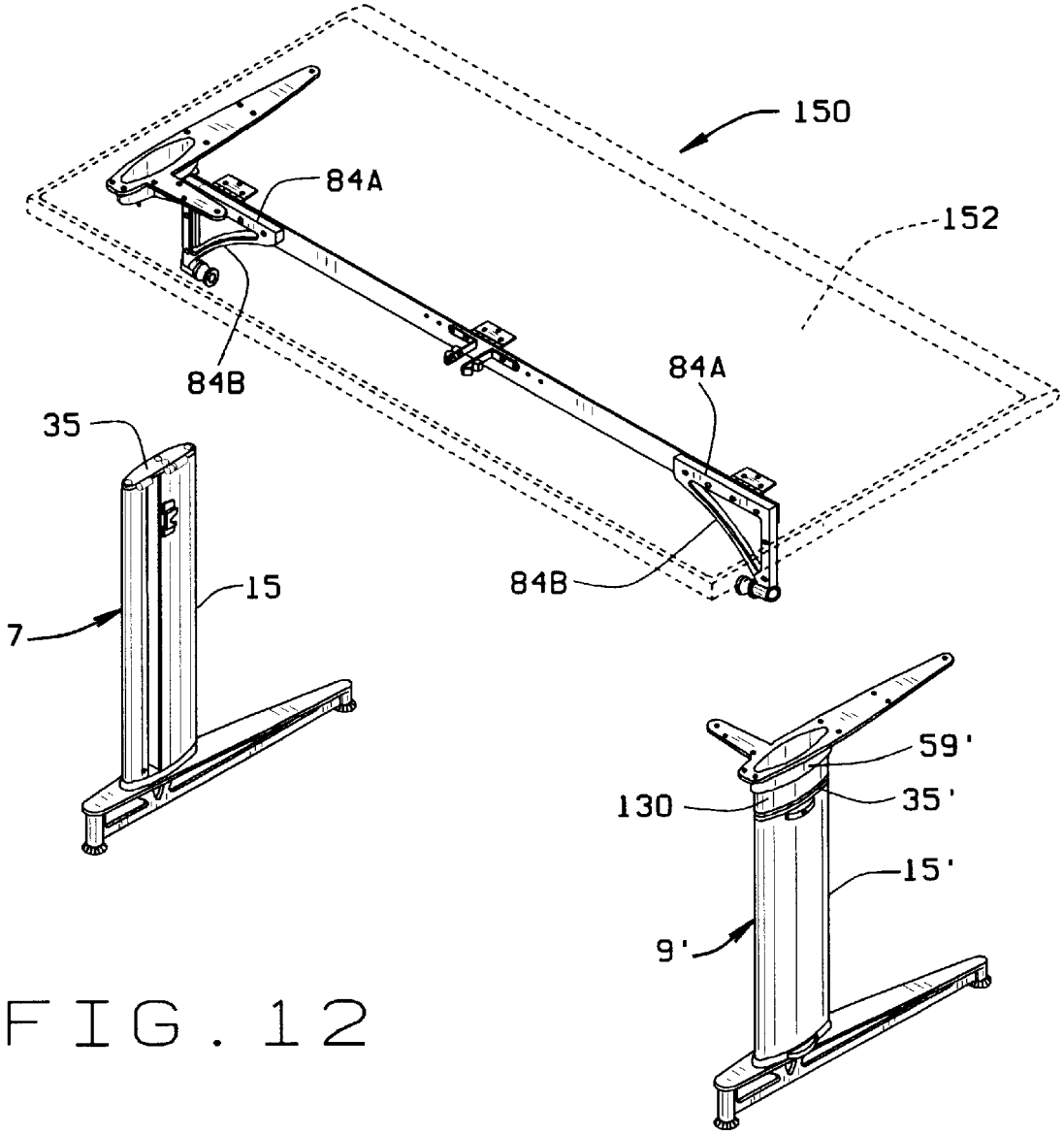
FIG. 12 is an exploded view of a second illustrative embodiment of folding table of the present invention.
Figure 13:
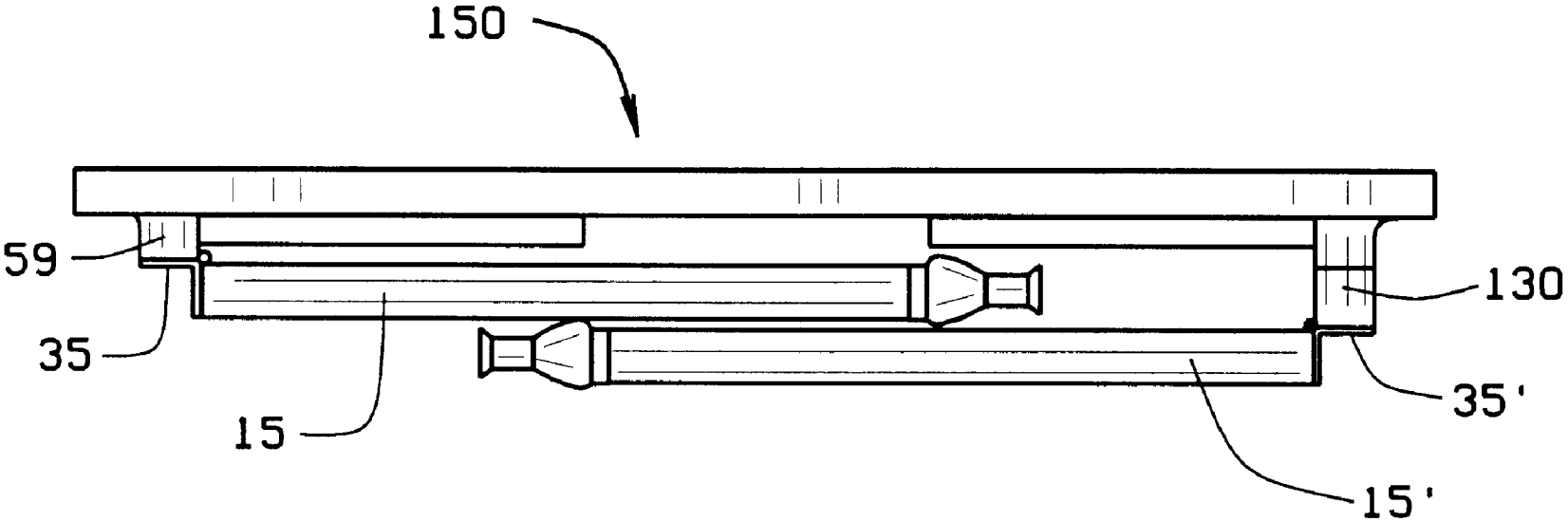
FIG. 13 is a front view of the folding table of FIG. 12 with the legs in a folded position.

It will be appreciated that various changes and modifications may be made in the folding table of the present invention without departing from the scope of the appended claims. For example, a folding leg assembly, indicated generally by reference numeral 9', is shown in FIG. 4 and illustrates the flexibility of the novel folding leg assembly design. Leg assembly 9' employs a spacer 130 between the skirt 59' and the hinge 35'. Spacer 130 is used to lower the hinge 35' employed on the leg assembly relative to the position of the hinge 35 employed on the opposite leg assembly. FIGS. 12 and 13 illustrate an embodiment of the folding table of the present invention, indicated generally by reference numeral 150, employing the leg assembly 9' of FIG.4 in conjunction with a table having a relatively shorter table top 152 than those previously described. Due to the use of spacer 130, the leg 15' can breakdown and fold under leg 15 of the opposite leg assembly 7.

Moreover, body 15 of the leg assemblies may be made longer, if the application so dictates a taller table. The basic elements of the folding table of the present invention are interchangeable and the table easily can be heightened or shortened by the use of or removal of spacer 130 or by the use of a longer leg assembly body 15.

Figure 14:
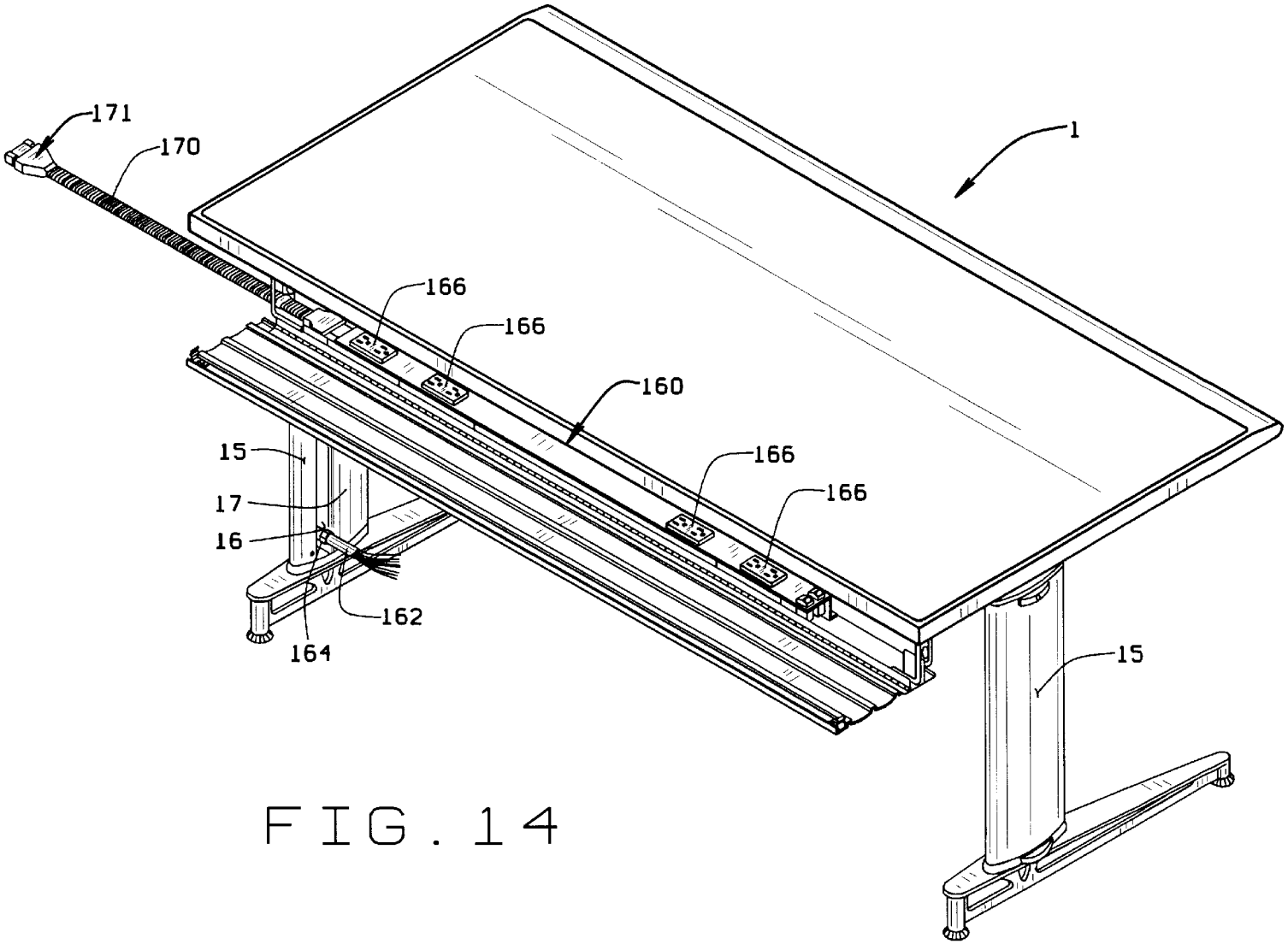
FIG. 14 is an isometric view of the folding table of FIG. 1 illustrating operation of the wire gallery of the present invention.
Figure 15:
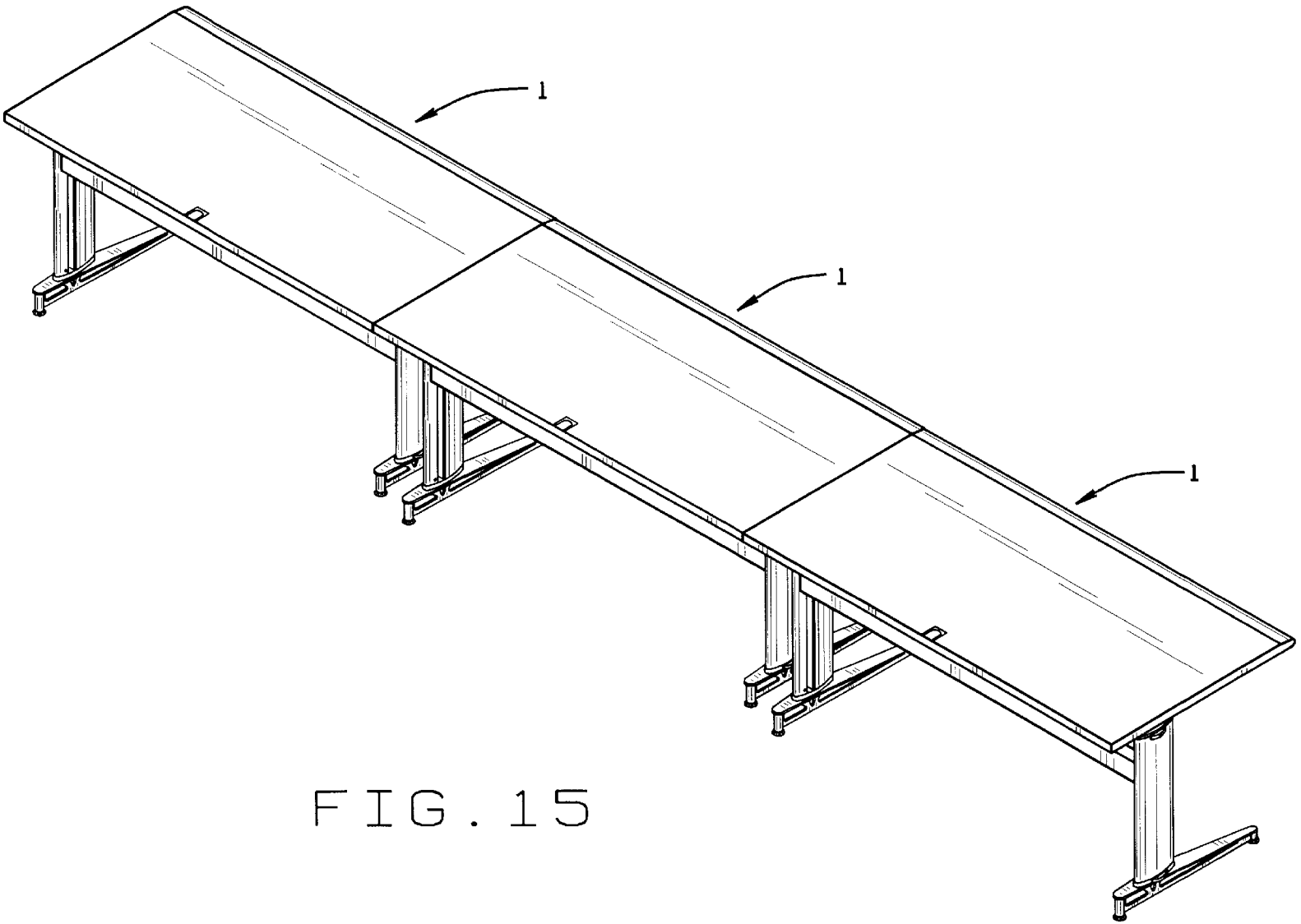
FIG. 15 is an isometric view of a plurality of folding tables of the present invention arranged end-to-end.

FIG. 14 illustrates a folding table 1 of the present invention with an electrical plug strip 160 seated in the wire gallery tray. A wire 162 connectable to a power source, such as a wall plug, enters opening 16 in leg 15 through a fitting 164. The wire 162 is electrically connected to the strip 160. Strip 160 has a plurality of individual plugs 166 for connecting various electric devices resting on the table top. Further, an extension 170 with a plug 171 is position between the wire gallery's two skeletal frames and exists under the table top. There is an extension plug 172 at the opposite end of strip 160. As should be appreciated, a plurality of tables 1 of the present invention can be aligned end-to-end, as shown in FIG. 15. The extension 170 of one table can engaged the plug 172 of an adjacent table, thereby electrically connecting all of the electronic devices on all of the tables 1.

As will be appreciated by those skilled in the art, the design silhouette of various components may be altered. For example, the brace members 81, 83 are shown as generally having a triangular shape. Other shapes are compatible with our invention. Likewise, we employ screw type fasteners in the assembly of various structural components. Other fasteners may be used, if desired. Since these variations are merely illustrative, the foregoing description and accompanying drawings should be viewed as illustrative only and should not be construed in a limiting sense.

We claim:

1. A foldable article including a top having an associated locking mechanism for releasably locking a foldable leg in an unfolded position supporting the top, comprising:

at least one brace extending between the top and the folding leg, the brace having a first end and a second end, the first end of the brace being operatively attached to the top and the second end of the brace having a plunger boss formed in it, said plunger boss being positioned in operational relationship to the foldable leg, the brace being pivotally mounted along the under side of the top between at least a first position interconnected with said foldable leg and a second stored position disconnected from said foldable leg;

a seat along the foldable leg, said seat being positioned in operational relationship to said plunger boss; and a spring-biased plunger carried by one of said plunger boss and said foldable leg, said spring-biased plunger being moveable between at least a first position wherein the plunger is biased into said seat and a second position wherein said plunger is withdrawn from said seat to permit movement of said brace toward said stored position.

2. The article of claim 1 further including a hinge positioned between said top and said leg.

3. The article of claim 2 further including a support beam which extends along the length dimension of the top, said support beam hingedly attached to said top, said brace being attached to and moveable with said beam.

4. The article of claim 3 wherein a downward force on said top acts through said brace to maintain the foldable leg in the unfolded position of said foldable leg.

5. A folding table top, comprising:

a beam pivotally attached to said top;

a brace having a first end and a second end, said brace being attached to said beam at the first end of said brace, said brace being moveable with said beam;

a plunger housing along said brace at a second end of said brace;

a plunger moveably mounted within said plunger housing;

a bias spring within the housing to bias said plunger toward a first position;

a leg assembly having a first part mounted to said top and a second part foldable with respect to the first part;

a plunger seat carried by said leg assembly along the second part thereof and disposed to seat said plunger when said plunger is in said first position;

said plunger being movable to second position wherein said plunger is withdrawn from said plunger seat so as to allow said brace to move away from said leg assembly.

6. The assembly of claim 5 wherein said plunger housing comprises a tubular wall integrally connected to the second end of said brace, said tubular wall defining an internal bore; and a bias spring seated in said bore.

7. In a table having a table top supported by spaced apart foldable leg assemblies and a support beam extending along the length dimension of the table top, at least on releasable brace between the beam and the leg assembly, the brace having a plunger boss formed on the base adjacent the leg assembly, and a spring-baised plunger in said boss, said plunger being moveble between a first position wherein said plunger engages and locks the leg assembly in an unfolded configuration and a second position wherein the plunger is removed from said leg assembly so as to allow said leg assembly to fold, said brace pivotally mounted along the under side of said table top, said brace and said foldable leg being positioned in an unfolded positioned so that a downward force on the top acts through said brace to maintain the foldable leg in the unfolded position of said foldable leg.

* * * * *

UNITED STATES PATENT AND TRADEMARK OFFICE

CERTIFICATE OF CORRECTION

PATENT NO. : 5,957,062
DATED : September 28, 1999
INVENTOR(S) : Lewis D. Cox and Steven J. Hill It is certified that error appears in the above-identified patent and that said Letters Patent is hereby corrected as shown below:

Column 8,
Line 9, replace “beam” with -- being --
Line 43, replace “on” with -- one --
Line 53, replace “positioned” with -- position --

Signed and Sealed this

Third Day of February, 2004

JON W. DUDAS
*Acting Director of the United States Patent and Trademark Office*